US005257010A

United States Patent [19]

Rehder

[11] Patent Number: 5,257,010

[45] Date of Patent: Oct. 26, 1993

[54] PROCESS FOR THE DEACTIVATION OF A REASONANCE LABEL AND CIRCUIT ARRANGEMENT FOR THE EXECUTION OF THE PROCESS

[75] Inventor: Jurgen Rehder, Bexbach-Hochen, Fed. Rep. of Germany

[73] Assignee: Actron Entwicklungs, Rotreuz, Switzerland

[21] Appl. No.: 6,165

[22] Filed: Jan. 19, 1993

Related U.S. Application Data

[63] Continuation of Ser. No. 690,692, Apr. 24, 1991.

[30] Foreign Application Priority Data

Apr. 25, 1990 [CH] Switzerland ..... 1396/90

[51] Int. Cl.[5] ..... G08B 13/24

[52] U.S. Cl. ..... 340/572

[58] Field of Search ..... 340/572

[56] References Cited

U.S. PATENT DOCUMENTS 5,023,600 6/1991 Szklany et al. ..... 340/572
5,027,106 6/1991 Lizzi et al. ..... 340/572
5,059,951 10/1991 Kaltner ..... 340/572

FOREIGN PATENT DOCUMENTS 0287905 10/1988 European Pat. Off. .
8504975 11/1905 PCT Int'l Appl. .
8704283 7/1987 PCT Int'l Appl. .

*Primary Examiner*—Glen R. Swann, III
*Attorney, Agent, or Firm*—Tarolli, Sundheim & Covell

[57] ABSTRACT

A process and circuit device for the deactivation and subsequent proof of a resonance label which has a resonant circuit with a certain Q factor and a certain frequency. The resonant circuit is energized with and disabled by a deactivation energy during deactivation. During deactivation, time is divided into a continuous alternating sequence of first and second time periods which directly follow one another. A transmission antenna transmits a deactivation energy during each of the first periods of time in the form of a sequence of separate deactivation impulses to cause the resonant circuit of the resonance label to oscillate in a resonant mode. The height and the width of each of the deactivation impulses and the number of the deactivation impulses within the impulse sequence are such that the impulse sequence delivers sufficient energy to deactivate the resonance label. The transmission is stopped and the transmission antenna is disabled for each of the second periods of time. A receiver is activated at the beginning of each of the second periods of time. The receiver receives decaying oscillations of a resonant label which is present and which has not successfully been deactivated during the preceding of the first time period.

20 Claims, 2 Drawing Sheets

PROCESS FOR THE DEACTIVATION OF A REASONANCE LABEL AND CIRCUIT ARRANGEMENT FOR THE EXECUTION OF THE PROCESS

This is a continuation of copending application Ser. No. 07/690,692 filed on Apr. 24, 1991.

BACKGROUND OF THE INVENTION

The invention concerns a process and a circuit arrangement for the deactivation, and subsequent proof of deactivation, of a resonance label.

A process of this sort is already known from the EP-A-287 905 which has also been applied successfully. However, it has to be considered that contradicting demands exist in regard to the power emitted by the deactivator. In order to be able to deactivate labels over the largest possible distance and to avoid tight production tolerance for economical reasons, the demand for the highest possible energy to be transferred onto the label exists. On the other hand, legal barriers are set in specific countries which set limits to the emitted power. These limits are simply necessary because of the required compatibility with components of radio frequency operated security devices. In this case the critical factors are the peak values and the duration of the operating factor of the emitted power.

SUMMARY OF THE INVENTION

The invention is thus based on the objective to transfer a maximum of energy onto the resonance label with the shortest possible sending duration and with low peak power. This objective is obtained by a process for the deactivation and subsequent proof of a resonance label which has a resonant circuit with a certain Q factor and a center frequency. The process can be performed by a circuit device. The resonant circuit is energized with and disabled by a deactivation energy during the deactivation process. The process includes the step of dividing the time into a continuous alternating sequence of first and second periods which directly follow one another.

The process includes transmitting, by means of at least one transmission antenna, a deactivation energy during each of the first periods of time in the form of a sequence of separate deactivation impulses for causing the resonant circuit of the resonance label to oscillate in a resonant mode. The height and width of each of the deactivation impulses and the number of the deactivation impulses within the impulse sequence being such that the impulse sequence delivers sufficient energy to deactivate the resonance label. The process includes stopping the transmission and disabling the at least one transmission antenna for each of the second periods of time. The process includes activating, at the beginning of each of the second periods of time, receiving means for receiving the decaying oscillations of a resonant label which is present and which has not successfully been deactivated during a preceding one of the first time periods.

The invention is based on measurements and experiments that show that the equilibrium between emitted energy and the energy used in the label by heat loss and radiation can already be obtained after relatively few oscillations with a constant electromagnetic alternating field and with a deactivation frequency that corresponds with the label. Each further oscillation emitted from the deactivation antenna increases the possibility of a deactivation of the resonance label only inconsiderably.

Because the process is executed with successive impulses within an impulse group instead of with single impulses, as it is suggested in the previously mentioned EP-A, each impulse represents an oscillation stimulation for the resonant circuit determined by the label, in which the energy which was only slowly released from the label is stored and built up within the label. Each single impulse can thus be considerably weaker than thus far assumed, if equally large ranges are considered. This means that the possibility of interferences by other components is also reduced considerably. Compared to conventional processes, this leads to practically no increase in the total emitted energy despite the utilization of one impulse group, which means from several impulses each, because the single impulses are weaker.

According to a preferred example, the process is executed such that the length of each of the first periods of time is calculated from the Q factor and the center frequency of the resonant circuit of the resonance label. In a preferred example, the length of each of the first periods is no more than 100 microseconds, preferably no more than 50 microseconds, and in particular no more than 10 microseconds. In a preferred example, the length of each of the second periods is at least ten times, preferably at least one hundred times, and in particular about one thousand times the length of the first period. It is generally possible to select the duration of the burst pauses, and the duration between two impulse groups (bursts), in such a way that a certain amount of energy from the previously emitted impulse group remains in the label if the same is not yet deactivated and thus might contribute to the oscillation buildup.

According to a preferred example, the circuit device has a clock generator for generating a clock frequency. The circuit arrangement has a first timing means connected to the clock generator. The first timing means derives from the clock frequency a first periodical sequence of impulses each of which has a length equal to one of the first periods. The circuit device has a second timing means connected to the first timing means. The second timing means derives from the first sequence of impulses a second periodical sequence of impulses of the same periodicity. Each of the impulses of the second sequence having a length equal to one of the second time periods and adjoining a respective impulse of the first sequence.

The circuit device has an impulse generator for generating a continuous sequence of the deactivation impulses with a certain frequency. The circuit device has a transmitting means with at least one transmission antenna. The transmitting means is connected to the impulse generator circuit via first control means which are controlled by the first sequence of impulses. The circuit device includes receiving means with at least one receiving antenna and second control means which is controlled by the second sequence of impulses. The circuit device includes disabling means which are connected to the at least one transmission antenna and is controlled by the second sequence impulses.

BRIEF DESCRIPTION OF THE DRAWINGS

Further details of the invention result from the following description of the examples that are schematically represented in the drawings. They show.

DESCRIPTION OF THE PREFERRED EMBODIMENT OF THE INVENTION

Figure 1:
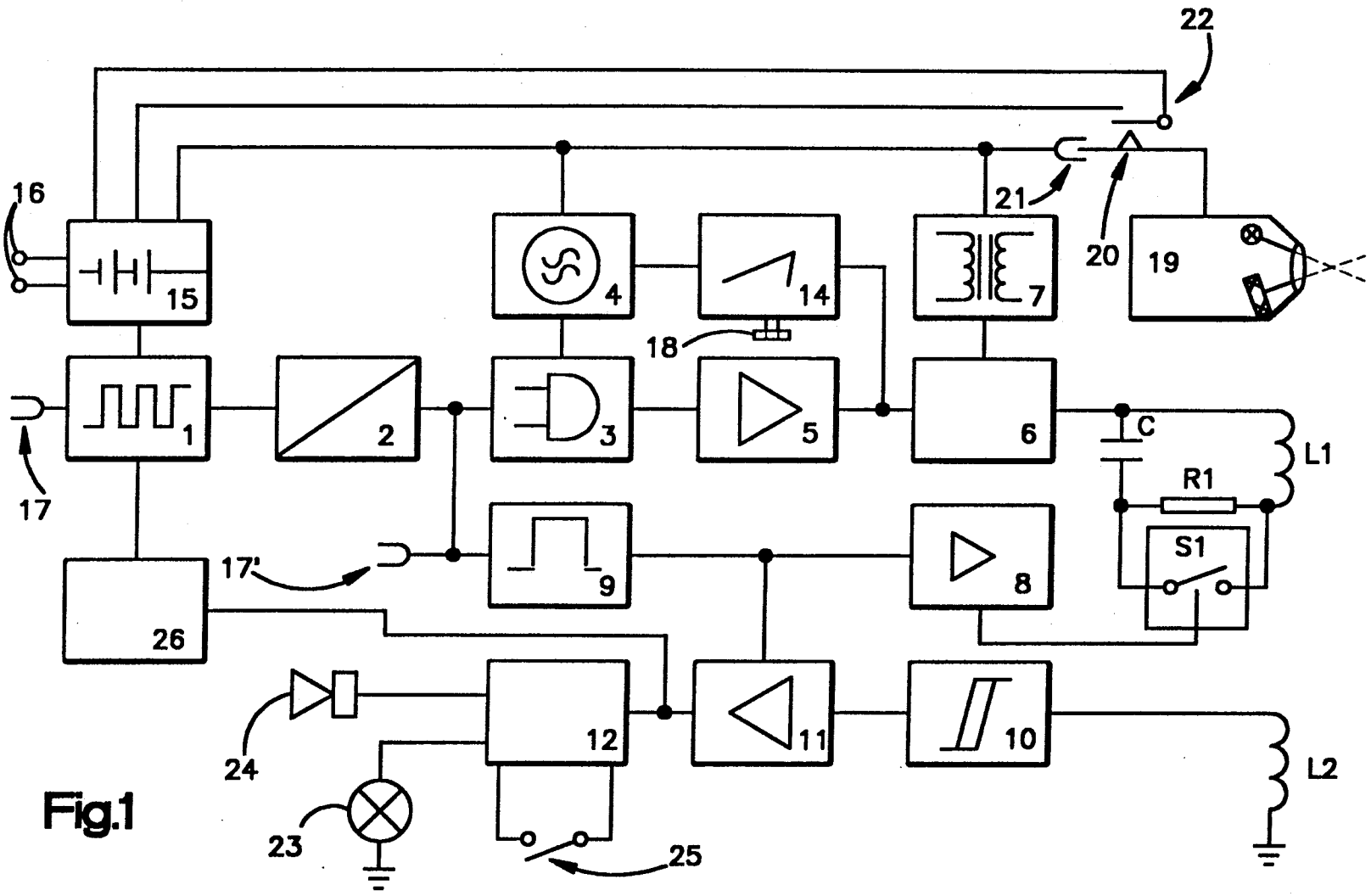
FIG. 1: a first example of a circuit arrangement according to the invention, in particular for battery operation.

A central clock generator 1, for example with a clock frequency of between 20 and 30 Hz, preferably 25 Hz, is supplied by a power supply unit 15 which can include one or more batteries, as this is symbolically shown; however, it can also be provided with circuit connectors 16 and, if so desired, can be switched between either one of the two power sources.

The clock generator 1 can be provided with a synchronization coupling 17 in order to be able to be synchronized with other devices. The frequency of the clock generator determines the number of transmissions (number of the emitted impulse groups or bursts per time unit) of the deactivation circuit. For this purpose a sequence of short strobe impulses is produced from the edges of the rectangular output voltage of the clock generator 1 by a stage 2.

It should also be mentioned that it would generally be possible to utilize a clock generator 1 with different forms of signals than rectangular impulses, but then a subsequently switched impulse forming stage would have to be inserted because only the most defined edges are advantageous for the production of the strobe impulses in the stage 2. This stage 2 represents some sort of time function element that determines the burst duration by the duration of the rectangular signals produced by it. It can, for example, be constructed as a flip-flop that reacts to the ascending edges of the rectangular signal produced by the clock generator 1.

Because the energy transmitted to the labels can only be effectively utilized during limited durations, the duration of the strobe impulses has to be limited correspondingly. The maximum number of impulses per impulse group will in general be determined by the Q-factor of the kind of resonance labels utilized. A label with a high Q-factor will most of the time necessitate more impulses until the equilibrium between the received and emitted power is obtained than a label with a lower Q-factor. It always should be remembered that the Q-factor, as already described in the EP-A-285 559, depends on one hand on the quality of the dielectric of the label and on the other hand on the size of the space free of conductive coating within the inductor winding. It is especially beneficial if the number of impulses per impulse group is calculated from Q/2, which means it corresponds with half the Q-factor. This means that, for example, a label with the factor $Q=100$ necessitates about 50 impulses which, for example, corresponds with a duration of the strobe impulses of about 6 microseconds with an impulse frequency of 8 MHz. This is the reason why the duration of the strobe impulses should amount to no more than 100 microseconds, but will lie considerably below this value in most cases, for example at about 50 microseconds. Practical experiences have shown that durations of 10 microseconds can be sufficient. These ratios can vary depending on the construction of the labels and the local conditions, but usable results were already obtained with durations of only about 5 microseconds ($\pm 1$ microsecond). It was even possible to obtain durations of only 1 microsecond.

The strobe impulses released by the time function element 2 reach the input of a gate circuit (AND-gate) 3, whose other input is connected with an impulse sequence generator 4 that preferably produces a sequence of rectangular impulses. This gate 3 is opened by the strobe impulses of the time function element 2 and allows the penetration of a group of impulses that were released by the generator 4 during the corresponding duration (the burst duration). The strobe time is selected in correspondence with the previously described text in order to allow the penetration of the desired number of impulses.

This clearly shows that the stages 1 through 4 together represent the impulse generator circuit for the emission of impulse groups or bursts. They can, if so desired, be replaced by other circuits, for example by an HF-start-stop generator that is activated by a time function element and thus switches itself off after each start and after emission of the predetermined number of impulses. The initially described solution is preferred because such a generator generally necessitates a certain response time.

It is already known that the resonance labels are subject to certain production tolerances, which should not be set too strictly for production purposes. Analog to this it is also possible that the natural frequency and/or resonance frequency of such labels can be subject to certain fluctuations. It is thus advantageous if the impulse sequence generator 4 either contains an impulse sequence frequency modulator within itself or, as shown, is connected with an external modulator 14. This stage 14 can be constructed in different forms and can also have different functions. An adjustment of the frequency spectrum is desired because an adaptation to the utilized labels is very advantageous. In this case, the stage 14 can be provided with a device that allows either continuous adjustment or a change-over.

For the purpose of modulation of the impulse sequence frequency, two other possibilities are applicable: the modulation can be executed either within a single impulse group or from burst to burst. Because the burst duration is relatively short, the first variation will only show conditional success if it is not coupled with at least the second variation. In the most simple structural solution, a modulator is constructed as a ramp generator which impresses a continuous displacement of the impulse sequence frequency on the generator 4, in which the displacement will show its effect within each impulse group, as well as from impulse group to impulse group. However, if the modulator 14 is controlled by the outputs of an amplifier stage 5 and is thus indirectly controlled by the strobe impulses of the time stage 2, then no displacement of the frequency occurs during the burst pauses between the single impulse groups, but always occurs during a strobe impulse, in which the length of the ramp corresponds with a multiple of the duration of the strobe impulse and is thus only completed after several strobe impulses.

The amplifier 5 has the role of a driving circuit for a high-level stage (power stage) 6 that obtains its power supply by a voltage transformer 7. This voltage transformer is, just like the HF-oscillator 4, shown as being connected to the supply stage 15 and can be provided with a separate power supply if the same is obtained by batteries. The signal is subsequently conveyed from the power stage 6 to the transmission antenna C, L1.

Because of the relatively low total energy consumption it is easily possible to construct the deactivation circuit as battery operated device. In any case it is advantageous to connect the circuit with a conventional bar-code-scanner 19 or to attach at least one of the two antennas C, L1 and/or L2 shown on the housing of this scanner 19. The scanner 19 can be constructed differently, however it is advantageous if a flatbed scanner or a vertical scanner, as they are utilized in cash registers, is applied.

The advantage of such a measure is clear: during the reading of the bar code, which is most of the time attached to a resonance label, by the scanner 19 an automatic and simultaneous deactivation of the label is executed. The deactivation circuit can be constructed much simpler because of the smaller dimensions (=lower deactivation output). With flatbed scanners the antenna is, for example, simply mounted onto the scanner as an accessory or with vertical scanners is simply assembled in front of the scanner. This can even result in an especially high deactivation rate, if the scanner is held immediately onto the label. This can even further reduce the necessary deactivation energy.

The scanner 19 can be connected to the shown circuit arrangement by means of a plug jack 20 and a coupling 21, in which the plug jack 20 can close the circuit for a change-over 22 that can selectively switch the power supply from battery operation to the main power supply circuit. This change-over also allows the switching to battery operation if so desired.

FIG. 1 shows that a second time function element 9, which can, for example be constructed as a flip-flop, is connected to the output of the time function element 2, in which this flip-flop produces strobe impulses with a considerably longer impulse duration compared to the impulse duration of the strobe impulses produced by the time function element 2. This time function element 9 switches on the reception circuit during the burst pauses. For this purpose the time function element 9 is triggered by the descending edge of the strobe impulse from the stage 2. The reception circuit detects a subsequently oscillating (and thus apparently not yet deactivated) label. Such a signal is received by the already mentioned reception antenna L2, which is switched before a limitation stage 10 in order to prevent a saturation and destruction of that part of the reception. As soon as an HF-amplifier 11 is released by the time function element 9, the received signal can be correspondingly amplified and conveyed to an evaluation stage 12 which, as symbolically shown, can also trigger optical and/or acoustical signal devices 23, 24.

It might also be desired to trigger the signals devices 23, 24 for different purposes. In some locations it might be preferred if the corresponding signal device 23 or 24 respectively is only triggered if a deactivation has not been executed. This will also be the normal scenario. Sometimes it might also be desired that the successfully executed deactivation is confirmed by the corresponding signal device 23 and/or 24 by activation of the same. If the latter is the case, only a selector switch 25 has to be connected to the circuit shown.

By different logical interactions it is also possible to activate other operational modes of the signal devices 23, 24, for example by interaction of the information "label registered," "label produces subsiding echo" (not deactivated), "label echo does not occur abruptly" (deactivated). The change-over 25 can be formed by a switch that can be adjusted to several different positions instead of by one simple switch, as it is shown.

FIG. 1 also shows that the time function element 9 does not only open and close a time window while the reception circuit L2, 10–12, 23–25 is activated, but that this time window signal also reaches a circuit stage S1 over an amplifier 8 (for the adaptation of the impedance).

An attenuator resistor circuit R1 is switched into the antenna circuit C, L1 by means of this circuit stage S1 which is preferably formed by an electronic switch. The attenuator resistor circuit R1 can be formed by a single attenuator resistor, as it is shown in our example, or by several elements. The interfering influence of the resonant antenna circuit C, L1 on the receptor circuit is largely eliminated by this attenuator resistor circuit R1 and thus simplifies the subsequent detection of eventual label echoes by the reception antenna L2. During the duration of the strobe impulses, which means while the bursts are emitted and increased power is fed into the antenna C, L1, the switch S1 is closed and the attenuator resistor circuit R1 is bypassed.

In order to avoid an influence of this label deactivation on a label detection system operating in the close vicinity, the clock generator 1 can be synchronized with this particular detection system. This can, for example, be obtained by means of a cable and the connector 17; on the other hand the necessary synchronization signal can also be obtained in a wireless manner from the reception circuit. For this purpose, the same is provided with elements 26 (FIG. 1) which are able to discriminate the signals received from the label detection system and to produce a suitable synchronization signal from the same for the synchronization of the impulse sequence transmission. It should also be mentioned that it might not only be desired to synchronize the clock generator 1 with other components by the connection 17, but to also divert a synchronization signal from the circuit in order to determine when a burst pause occurs. This can be obtained by a synchronization output 17'.

Figure 2:
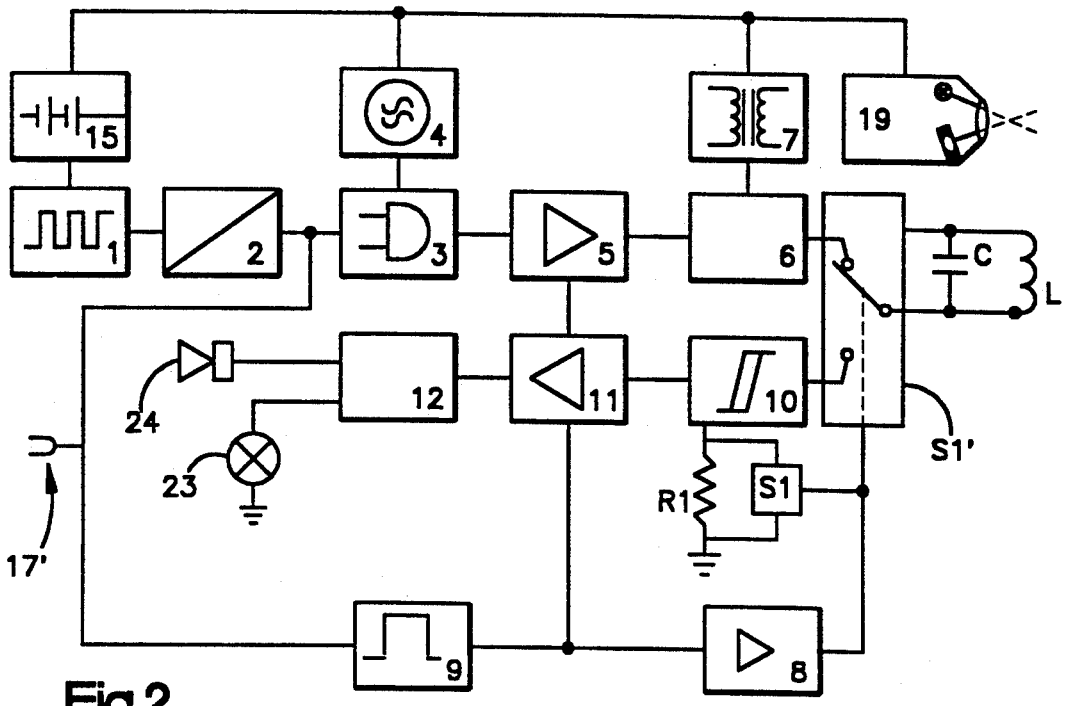
FIG. 2: an alternative with a simplified circuit.

In the example according to FIG. 2 the same elements that have the same function also carry the same reference symbols as in FIG. 1. In this case some elements of the illustration in FIG. 1 are missing, because they either are actually not present or are present but not shown. In any case it is understood that the single characteristics of the different examples can be replaced amongst each other and/or combined with each other.

This again primarily concerns a battery operated device, although a power circuit operated device is also possible. This can also be seen in connection with a bar-code-scanner 19. In order to simplify the circuit and to be able to attach the antenna C, L in a more simple manner on the housing of the scanner 19, only one single antenna C, L is provided which is alternately operated as transmission and reception antenna.

For this purpose, the output of the power stage 6 and the input of the limitation stage 10 is connected with a controlled change-over stage S1' that alternately connects the antenna C, L with the output of the power stage 6 and/or the input of the limitation stage 10. The control of this change-over stage S1' is executed by the time window signal of the time function element 9 and the amplifier 8, similar to the circuit stage S1 in FIG. 1. This means a more space-saving form of construction and represents an advantageous form of construction, compared to conventional circuits in which such a change-over possibility is rather unlikely. The attenuator resistor R1 can be switched as natural resistor of the limitation stage 10 and can be bypassed by the circuit stage S1. It could also be switched off in a different manner than by bypassing.

If a label assumes a difficult position relative to the transmission antenna, as for example exactly vertical to the antenna, then it can practically receive no energy from the same. In order to avoid this, it is advantageous if a number of transmission antennas are provided, which means at least two. In the case of two transmission antennas C1', L1' and C", L" shown in FIG. 3 it is advantageous (because of the occurrence mentioned in the beginning of this paragraph) if these antennas are arranged vertically to each other. If more than two antennas are provided, which will generally not be necessary, they can be arranged in corresponding angles to each other.

In this case it is of the utmost importance that the output signals of the power stage 6 are distributed on the transmission antennas C', L1' and C", L1", which in turn is obtained by a change-over stage S1" that is assigned to the antennas and has the function of a multiplex stage if several antennas are provided. However, this multiplex stage S1" is not controlled by the time function element 9 like the other antennas that are assigned to the circuit stage S1' and S1, but by a frequency divider 13 that again divides the strobe impulses from the time function element 2 in order to convey the impulses of an impulse group to the antenna C1', L1' in half of the time and to the antenna C", L1" in the other half of the time. In correspondence with this, the strobe impulses of the stage 2 will be longer than in the cases described in FIGS. 1 and 2.

Because in this case another separate reception antenna is used, it is suggested that absorptive attenuators R1' and R1" should be provided in the antenna circuits C', L1' and C", L1" and that the same can be bypassed for the transmission mode by the circuit stages S1*a* a and S1*b*. Because the transmission antennas are only effective in succession, it would also be possible to not address them by the time function element 9, but to also synchronize them with the frequency divider 13, but this effort is not necessary in most cases. It would also be possible to address the two antennas circuits C', L1' and C", L1" in a parallel manner from the output of the power stage instead of after each other; however, this would lead to a separation of the energy which in turn can lead to problems and which is the reason why the shown arrangement of a multiplex stage S1" is preferred. It is also understood that such an arrangement of several transmission antennas can be realized advantageously independent from the fact if the process is executed with the described burst signals or not and if the described attenuator arrangement R1, R1' or R1" that can be switched off is present or not. On the other hand, such a multiple antenna arrangement can also be applied advantageously in the examples according to FIG. 1 or 2.

Especially with several antennas it can be advantageous if the entire arrangement is assembled within a housing 26 from which only the signal devices 24 and 23 lead towards the outside. Such a housing 26 is constructed as an HF-tight housing that is provided with at least one entry opening (if desired, also with an exit opening according to luggage x-ray apparatuses in airports) that can be closed by a lid, in which the product for the activation of the label is inserted into the housing or is conveyed through the same. In this case the construction can be chosen in such a way that a deactivation switch is closed when the housing lid is shut, by means of which a deactivation impulse, or, as in the case of the above described invention, an impulse group (burst) is released.

Figure 3:
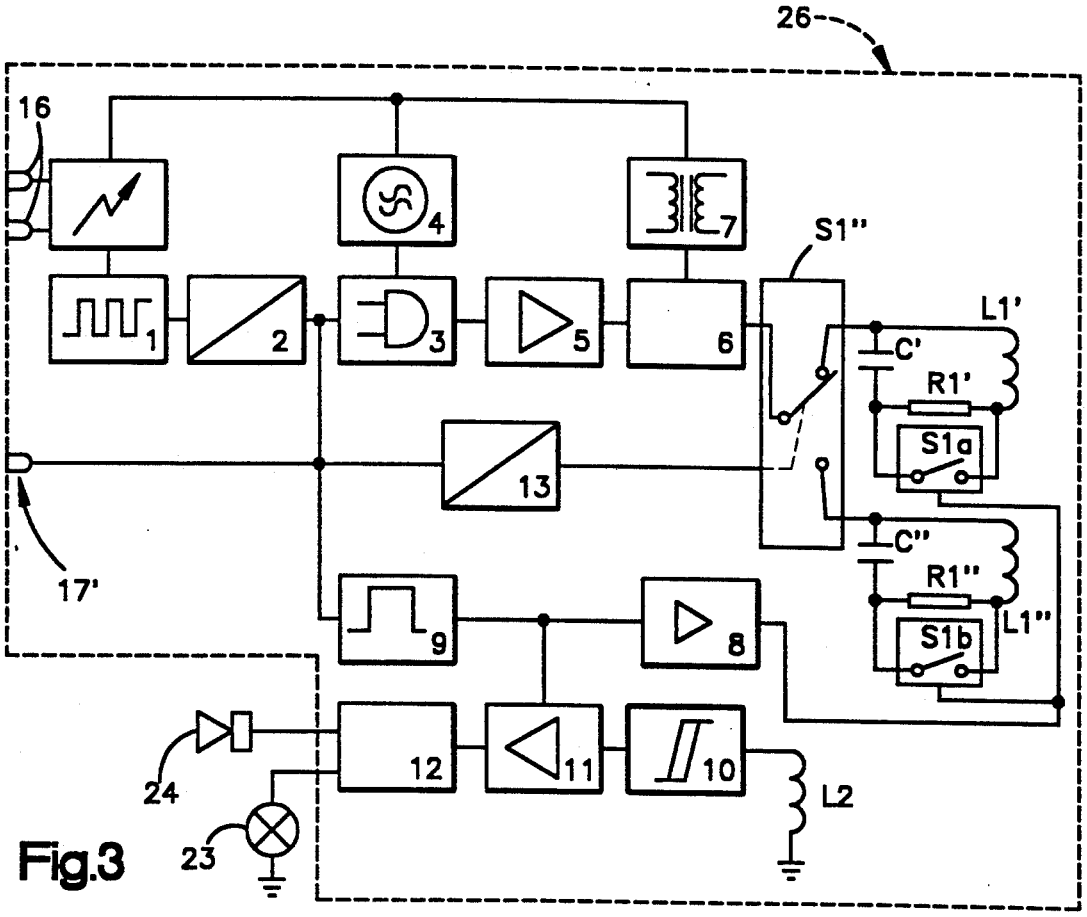
FIG. 3: a modified example with at least two transmission antennas.

Several modifications are possible within the general idea of the invention; it is thus understood that the stage 13 in FIG. 3 represents a synchronization element which can be replaced by any other synchronization circuit, if so desired.

An additional time function element that is controlled by the stage 2 and is synchronized with the same, could be provided for the control of the change-over device S1' in FIG. 2, but the utilization of the time function element 9 that is necessary anyhow and that produces the burst pauses is considerably simpler.

Further modifications can result from the housing 26 and its lid that activates the deactivation switch: it is not absolutely necessary that the deactivation is triggered by such a switch; it is possible to run the deactivation signal within the housing 26 in a continuous mode, especially if the housing is constructed as conveyance housing. On the other hand, in most cases such a trigger switch will be desired, even if there is no housing 26 provided. Such a trigger switch (although not shown) can be arranged on different locations, for example on the power supply unit 15 itself, in order to be able to switch the same on and off centrally and to switch off all circuit elements. It would also be possible to run at least part of the circuit in the mode of a standby operation (for example the clock generator 1 or the impulse sequence generator 4) and to only switch off the remaining parts or to arrange the trigger switch between the power supply unit 15 and the clock generator 1, in which case an opening of the gate circuit 3 is impossible. A further possibility consists of the fact to arrange the trigger switch between the oscillator 4 and the AND-gate 3, in which the oscillator 4 can run freely and is only switched into the circuit if this is desired. In an alternate version it would also be possible to arrange the trigger switch between the voltage transformer 7 and the high-level stage 6. The antenna provides only weak signals that energize the resonance of the label only if the trigger switch is not activated, in order to detect a theft attempt. On the other hand it provides the deactivation impulses. In this case it is advantageous to arrange a connection with an operational mode switch that corresponds with the switch 25, yet shows several different positions, for the evaluation circuit 12, in order to release a "theft detection signal" if the transmission antenna only releases weak label detection signals, but on the other hand only differentiates between "label deactivated" or "label not deactivated."

As far as the time function element 2 is concerned it can be constructed as a multivibrator, in particular an unstable multivibrator. However, it can preferably contain a counter, that counts the received clock impulses and forms the corresponding strobe impulses from the same.

I claim:

1. A process for the deactivation and subsequent proof of a resonance label which has a resonant circuit with a certain Q factor and a center frequency, the resonant circuit being energized with and disabled by a deactivation energy during said deactivation process, said process comprising the steps of:

dividing time into a continuous alternating sequence of first and second time periods which are directly following one another;

transmitting, by means of at least one transmission antenna, a deactivation energy during each of the first periods of time in the form of a sequence of separate deactivation impulses, the height and the width of each of the deactivation impulses and the number of the deactivation impulses within the impulse sequence being such that the impulse sequence delivers sufficient energy to deactivate the resonance label for causing the resonant circuit of the resonance label to oscillate in a resonant mode;

stopping said transmission and disabling the at least one transmission antenna for each of said second periods of time; and activating, at the beginning of such of the second periods of time, receiving means for receiving decaying oscillations of a resonant label which is present and which has not successfully been deactivated during the preceding of the first time periods.

2. A process as set forth in claim 1, wherein the length of each of the first periods of time is calculated from the Q factor and the center frequency of the resonant circuit of the resonance label, the length of each of the first periods being no more than 100 microseconds, the length of each of the second periods of time being at least ten times the length of the length of each of the first periods of time.

3. A process as set forth in claim 2, wherein the length of each of the first periods of time is no more than 50 microseconds.

4. A process as set forth in claim 3, wherein the length of each of the first periods of time is no more than 10 microseconds.

5. A process as set forth in claim 2, wherein the length of each of the second periods of time is at least one hundred times the length of each of the first periods of time.

6. A process as set forth in claim 5, wherein the length of each of the second periods of time is at least one thousand times the length of each of the first periods of time.

7. A process as set forth in claim 2, wherein the sequence of deactivation impulses includes a maximum of 100 impulses.

8. A process as set forth in claim 7, wherein the sequence of deactivation impulses includes about 50 impulses.

9. A process as set forth in claim 1, wherein the sequence of deactivation impulses is periodical with certain impulse frequency, and the impulse frequency is modulated within said sequence and/or during successive of said first periods of time.

10. A circuit device for the deactivation and subsequent proof of a resonance label which has a resonant circuit with a certain Q factor and a center frequency, the resonant circuit being energized with and disabled by a deactivation energy, said circuit device comprising:

a clock generator for generating a clock frequency;

first timing means connected to said clock generator, said first timing means deriving from said clock frequency a first periodical sequence of impulses each of which has a length equal to a first time period;

second timing means connected to said first timing means, said second timing means deriving from said first sequence of impulses a second periodical sequence of impulses of the same periodicity, each of said impulses of the second sequence having a length equal to one of a second time period and adjoining a respective impulse of the first sequence, the first and second time periods being in continuous alternating sequence directly following each other;

an impulse generator for generating a continuous sequence of the deactivation impulses with a certain impulse frequency;

transmitting means with at least one transmission antenna, said transmitting means being connected to said impulse generator circuit via first control means which are controlled by said first sequence of impulses, means transmitting a deactivation energy during each of the first periods of time in the form of a sequence of separate deactivation impulses, the height and the width of each of the deactivation impulses and the number of the deactivation impulses within the impulse sequence being such that the impulse sequence delivers sufficient energy to deactivate the resonance label for causing the resonant circuit of the resonance label to oscillate in a resonant mode;

receiving means with at least one receiving antenna and second control means which are controlled by said second sequence of impulses, said receiving means being activated at the beginning of each of the second periods of time for receiving the decaying oscillations of a resonant label which is present and which has not successfully been deactivated during the preceding of the first time periods; and disabling means which is connected to said at least one transmission antenna and is controlled by said second sequence of impulses, said disabling means stopping the transmission and disabling said at least one transmission antenna for each of the second periods of time.

11. A circuit device as set forth in claim 10, wherein the impulse frequency of said impulse generator is controlled by a frequency modulation circuit, and said frequency modulation circuit is provided with an adjustment device for the adjustment and change of the impulse frequency.

12. A circuit device as set forth in claim 11, wherein said disabling means includes a controllable attenuator which is in series with said at least one transmission antenna.

13. A circuit device as set forth in claim 11, wherein said transmitting means includes an amplifier and at least two transmission antennas which are arranged vertical to each other and can be connected alternatingly to said amplifier by means of a switching circuit.

14. A circuit device as set forth in claim 10, wherein said disabling means includes a controllable attenuator which is in series with said at least one transmission antenna.

15. A circuit device as set forth in claim 10, wherein said transmitting means includes an amplifier and at least two transmission antennas which are arranged vertical to each other and can be connected alternatingly to said amplifier by means of a switching circuit.

16. A circuit device as set forth in claim 10, including at least one antenna used as said at least one transmission antenna and as said at least one receiving antenna, said transmitting means and said receiving means each include an amplifier, said disabling means includes a switching circuit which disconnects said at least one antenna from said transmission amplifier and connects it to said receiving amplifier.

17. A circuit device as set forth in claim 10, wherein said circuit device is connected with a bar-code scanner, on which at least one of said transmission and/or receiving antennas is arranged.

18. A circuit device as set forth in claim 10, wherein said receiving means includes an evaluation circuit which can be selectively switched by means of an operational mode switch to either display the confirmation of a successful deactivation of said resonance label or to an alarm display mode for unsuccessful deactivations.

19. A circuit device as set forth in claim 10, wherein said circuit device being positioned within an rf-tight housing with at least one opening as receptacle for a material to be tested, said housing including a lid movable to close the opening, movement of said lid operates a trigger switch for starting said deactivation process.

20. A circuit device as set forth in claim 10, wherein said receiving means includes elements for discriminating signals that are released by label detection devices installed in the close vicinity and which produce a suitable synchronization signal from said signals for a synchronization of said deactivation impulse sequence transmission.

* * * * *